United States Patent [19]

Ying

[11] Patent Number: 4,488,594

[45] Date of Patent: Dec. 18, 1984

[54] FIRED HEATER FOR COAL LIQUEFACTION PROCESS

[75] Inventor: David H. S. Ying, Macungie, Pa.

[73] Assignee: International Coal Refining Company, Allentown, Pa.

[21] Appl. No.: 543,638

[22] Filed: Oct. 19, 1983

[51] Int. Cl.[3] ..... F28D 7/02

[52] U.S. Cl. ..... 165/163; 122/248; 122/250 R; 165/177

[58] Field of Search ..... 165/163, 177; 122/248, 122/249, 250 R

[56] References Cited

U.S. PATENT DOCUMENTS

| | | | |
|---|---|---|---|
| 2,769,772 | 11/1956 | Gomory | 122/249 X |
| 3,379,244 | 4/1968 | Gilli | 165/163 |
| 4,291,546 | 9/1981 | Rodth | 165/163 X |

*Primary Examiner*—Edward G. Favors

*Attorney, Agent, or Firm*—Kimbley L. Muller

[57] ABSTRACT

A fired heater for a coal liquefaction process is constructed with a heat transfer tube having U-bends at regular intervals along the length thereof to increase the slug frequency of the multi-phase mixture flowing therethrough to thereby improve the heat transfer efficiency.

8 Claims, 4 Drawing Figures

FIG. 1
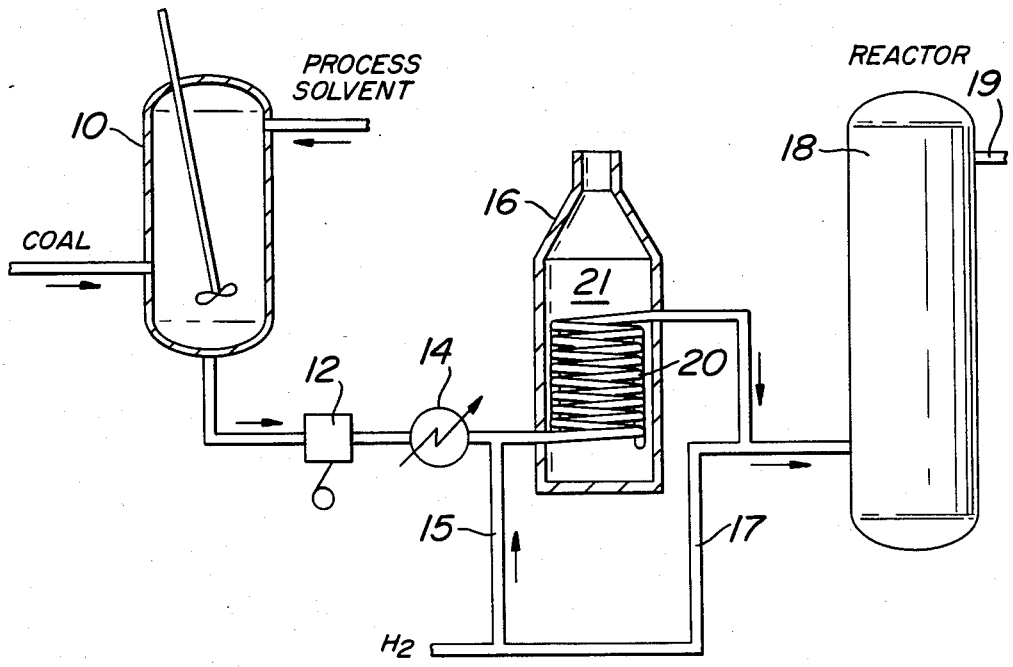
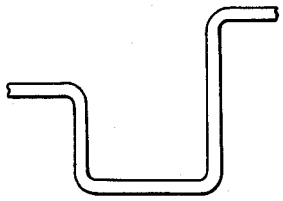
FIG. 3
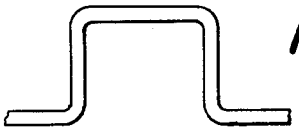
FIG. 4
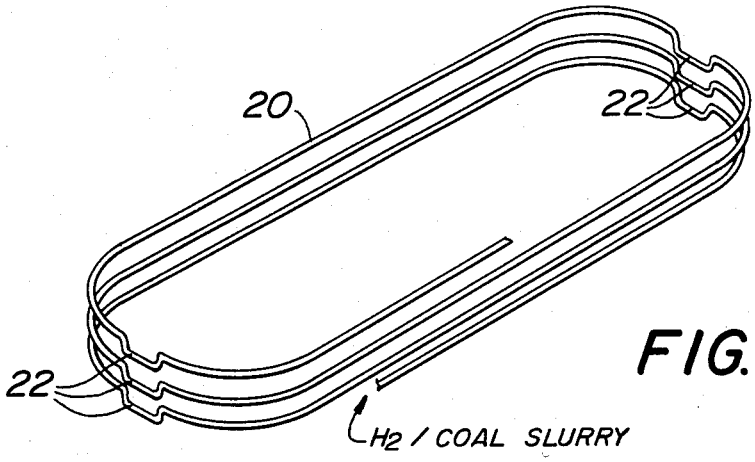
FIG. 2

FIRED HEATER FOR COAL LIQUEFACTION PROCESS

The Government of the United States of America has rights in this invention pursuant to Contract No. DE-AC05780-R03054 (as modified) awarded by the U.S. Department of Energy.

BACKGROUND OF THE INVENTION

This invention relates generally to an improved fired heater for a coal liquefaction process. More particularly, this invention relates to a fired heater for a coal liquefaction process constructed to improve the heat transfer efficiency thereof.

In the conversion of coal to synthetic fuels by direct liquefaction, the coal is mixed with a recycle solvent and is hydrogenated in a three phase reactor at temperatures in the range of 750°-880° F. (399°-471° C.) and pressures in the range of 1000-3000 psi ($6.89\times10^7-2.07\times10^8$ dynes/cm$^2$). In a direct coal liquefaction process, for example the SRC-I process, coal is mixed with solvent at low temperature (typically from 100°-450° F.) (38°-232° C.) at atmospheric pressure. The resulting slurry is pumped to a high pressure for example 2500 psi, ($1.72\times10^8$ dynes/cm$^2$) and is then preheated in heat exchangers to a temperature of approximately 500° F. (260° C.). Hydrogen gas is then added to form a three phase mixture of hydrogen/solvent/coal which is heated to a temperature of 650°-800° F. (343°-427° C.) in a fired heater by passing the mixture through a heat transfer tube having a very long length to diameter ratio. The preheated three phase mixture is then passed to a reactor vessel in accordance with the SRC-I process.

The fired heater is a critical component in a process for the direct liquefaction of coal. Because of the high operating pressure and temperature and the erosive/corrosive nature of the coal slurry, expensive materials are required for the fired heater making this unit a major cost item in the coal liquefaction process.

As stated above, the function of the fired heater is to heat the hydrogen/solvent/coal three-phase mixture flowing from the slurry preparation stage to the dissolver. The fuel required to preheat the feed to the reaction temperature is a major expense in any coal processing plant. In order to minimize the total energy load required for preheating and thereby reduce the fuel requirements of a plant, heat exchangers may be injected into the feed system to raise the temperature to as high a level as possible by using heat generated from other areas of the plant from various cooling steps. Heat transfer media or suitable substitutes are commonly used to effect such heat transfer from one location to another. However, it is still necessary that considerable heat be added to even a pre-warmed slurry to get it up to the reaction temperature.

In coal liquefaction plants the efficiencies in the fired heater both in equipment and fuel requirements can have a major impact on the cost of building and operating such a plant. Since the process operates at high pressures, very expensive equipment is required to contain the very corrosive reaction media. The major cost associated with the fired heaters based upon heaters having nearly the same level of heat input is the length and size of the fired heater tube. Generally, the shorter the tube length at constant heat input, the less expensive the total fired heater. Alternatively, for the same tube length, the heating rate to the fired box can be turned down to reduce fuel expense. The behavior of three-phase mixtures flowing through such systems at high heat fluxes also contrains the size and shape of these tubular systems. On the one hand, utilizing a system with a large tubular diameter will result in diminished heat transfer to the reaction media. On the other hand, using a diameter which is quite small will result in problems associated with very high erosion rates within the tubes brought on by the very rapid movement of the slurry through the pipe.

Fired heaters can be of several configurations. The pipes can run in horizontal or near-horizontal configurations slowly spiraling upward as the pipe winds its way around a circular or race track type pathway. Because of the long lengths of pipe often used, the height of such units becomes quite large, and because of the costs associated with erecting high structures, a cost incentive exists to minimize the overall height of these structures.

Another configuration used in these fired heaters is an up and down pattern resembling an upright radiator and comprised of a series of hairpin turns at the top and bottom. Because of problems associated with materials that could accumulate in the lower bends such a design is less favorable for use in a coal liquefaction plant.

As described in U.S. patent application (Ser. No. 543,639) filed by Ying et al simultaneously herewith, when a gas-slurry system flows through a horizontal or near-horizontal pipe at gas superficial velocities from 1 to 20 ft/sec (0.30 to 6.10 m/sec) and slurry superficial velocities greater than 1 ft/sec (0.30 m/sec), slug flow occurs. Slug flow refers to a behavior of the mobile phase in the pipe wherein the slurry phase will intermittently bridge the cross-sectional area of the pipe. Most of the time the top section of the pipe will be in contact with "slugs" of gas which are moving through the system. Heating the contents of the pipe would be far more efficient if the slugs of gas could be eliminated thereby allowing the slurry to completely fill the pipe bridging the cross-sectional area as it progresses through the preheater from one end to the other. Such a mode of operation puts slurry in contact with the walls most of the time thereby increasing heat transfer.

Unfortunately, in coal liquefaction preheaters in which three-phase flow must occur such completely flooded pipe designs are not acceptable. Froth flow would accomplish such a desired uniform flooding effect, but such behavior can be accomplished only at very high velocities where erosion by the particulate material would be severely limiting. It is known to those skilled in the art of heat transfer and fluid mechanics that higher heat transfer will also occur at higher frequencies for systems operating in a slug flow mode. These higher slug frequencies are also accompanied by higher slurry linear velocities through the tube which means that at higher slurry rates through the pipe heat transfer per surface area of the pipe will be more efficient.

Under all circumstances some hydrogen must be in contact with the flowing slurry in order to retard the coking that often happens in its absence. Therefore, since some gaseous hydrogen must be present, it is desirable to minimize the gaseous phase to as low a level as possible for acceptable operation in order to maximize heat transfer by maximizing contact of the slurry with the total pipe wall surface. Based on the fact that some hydrogen gas must be present, higher heat transfer is also helped by maintaining high slug frequencies in the pipe. This promotes frequent complete bridging of the pipe diameter.

In said prior-mentioned application, there is described an improved fired heater which is operated at gas and slurry flow rates and with pipe diameters so as to increase the frequency of slugs flowing through the pipe to thereby improve the heat transfer efficiency of the heater.

SUMMARY OF THE INVENTION

It is the general object of the invention to provide an improved fired heater design so as to increase the frequency of slugs flowing through the heat transfer pipe to thereby improve the heat transfer efficiency of the heater.

Briefly stated, the improved fired heater of the invention comprises a heat transfer tube for the flow of a multi-phase mixture through the heater constructed and arranged to pass through the heat transfer chamber of the heater in a substantially horizontal path moving vertically up through this chamber and having U-bends at regular intervals along the length thereof. The provision of the U-bends serves to increase the slug frequency and thereby improve the heat transfer efficiency of the fired heater. In addition, the provision of the U-bends serves to improve the dispersion of the three phase hydrogen/solvent/coal mixture in the SRC process.

The novel design in accordance with the invention serves to control and improve the slug frequency in both a near horizontal inclined flow or a horizontal flow to thereby improve the energy efficiency of the fired heater. In accordance with another aspect of the invention the intervals between the U-bends is to be less than 200 times the ratio of the length to the diameter of the tube. Moreover, the heater design in accordance with the invention has been found to be highly effective especially at low gas flow rates, ie., less than three feet per second (0.91 m/sec) superficial gas velocity. Furthermore, the cost of implementing the simple design in accordance with the invention in the fired heater of the SRC process is negligible.

BRIEF DESCRIPTION OF THE DRAWINGS

FIG. 1 is a schematic view of part of an SRC-I process incorporating a fired heater in accordance with the invention.

FIG. 2 is a view showing a fired heater tube design in accordance with the invention.

FIG. 3 is a view showing a modified form of U-bend design.

FIG. 4 is a view showing an alternative modified form of U-bend design.

DETAILED DESCRIPTION OF THE PREFERRED EMBODIMENT

In FIG. 1 there is shown a schematic illustration of part of an SRC-I process to which the fired heater of the invention is applicable. In this process, feed coal, typically finely crushed bituminus coal, is mixed with a recycled process solvent in a slurry mix tank 10 in a suitable coal-solvent ratio. The coal-solvent slurry from tank 10 is passed to a pumping unit 12 that pumps the slurry up to a pressure in the range of 1000–3000 psia ($6.89\times10^7$–$2.07\times10^8$ dynes/om$^2$). The pressurized slurry is heated to an intermediate temperature of about 500° F. (260° C.) by a heat exchanger 14 wherein, typically, a heated recycle solvent is passed in heat exchange relationship with the slurry. The heated slurry is combined with hydrogen rich gas via line 15 and the three-phase gas/slurry stream is introduced into the fired heater 16 of the preheater system where the temperature is rapidly increased. Fired heater 16 is comprised of an externally heated tubular reactor having a heat transfer tube 20 passing through the heat transfer chamber 21 of fired heater 16 as is shown schematically in FIG. 1. The three-phase mixture is heated to the reaction temperature in fired heater 16 by passing through a long length of tube 20 which is exposed to high temperatures from the heating means of fired heater 16, heat being transferred to the three phase mixture passing through tube 20 to raise the temperature thereof to a level of 650°–800° F. (343°–427° C.).

A second portion of the hydrogen gas stream is added to the preheated slurry via line 17 and the mixture is passed to a first coal liquefaction vessel 18 of a dissolver zone. Typically, this first vessel 18 is a bubble column adiabatic reactor vessel as is conventional in the art. The products from the first reactor vessel flow to a second reactor vessel via a line 19. The gas and slurry mixture passes from the dissolver zone to a gas separation and purification zone, a vacuum distillation zone, and a solid separation zone in accordance with the SRC-I process as is conventional in the art. Briefly, the reactor products are cooled and separated in a vessel into a vapor fraction containing vaporized light oil and gases and a slurry fraction which is processed further to separate solvent refined coal, recycled solvent and ash residue by methods conventional in the art as is described in said prior-mentioned application.

The novel construction of heat transfer tube 20 is shown in detail in FIG. 2. Heat transfer tube 20 is constructed and arranged to pass through the heat transfer chamber 21 of fired heater 16 in a substantially horizontal path moving vertically up through said heat transfer chamber. Preferably, tube 20 is inclined slightly to the horizontal at an angle of inclination of about one degree.

In accordance with the invention, tube 20 is provided with U-bends 22 at regular intervals along the entire length thereof as is shown in FIG. 2. U-bends 22 may have various geometric configurations but essentially provide a sharp bend to the flow of the three phase mixture flowing through tube 20. By this arrangement, the slug frequency of the three phase mixture is increased to thereby improve the energy efficiency of the fired heater. Moreover, the U-bend geometry creates a highly dispersed hydrogen/solvent/coal mixture.

Preferably, the intervals of the U-bends 22 are less than 200 times the length to diameter ratio of the tube 20. Also, the design of the invention has been found to be highly effective at low gas flow rates such as less than three feet per second (0.91 m/sec) superficial gas velocity.

While in the preferred form of the invention tube 20 is inclined slightly to the horizontal since this improves the slug frequency as is described in said prior-mentioned application, the invention is applicable to horizontal tubes which are common in the art. Accordingly, the invention applies to tubes having a "substantially horizontal path" moving vertically up through the heat transfer chamber 21 which terminology for purposes of this invention covers both a horizontal and a near horizontal tube construction, for example a [illegible]° inclination from horizontal.

In a horizontal tube construction, the vertical movement through the heating chamber can be achieved by utilizing different heights for the vertical legs of the U-bends as shown in FIG. 3.

EXAMPLE

Table 1 sets forth experimental data obtained in a test setup comprising a 3-inch diameter (7.6 cm) pipe having a one degree inclination and a U-bend design. The data in Table 1 is for the slug frequency of an air/water simulation experiment conducted to examine the effectiveness of the design in accordance with the invention to increase slug frequency in near-horizontal inclined flow (one degree upward). Data is presented for various combinations of liquid and gas superficial velocities.

Slug frequency was measured at tube length to diameter ratios (L/D) of 40 and 200 and was compared with tube constructions without the U-bend design at several flow conditions as indicated on Table 1. Table 1 shows a substantial increase in slug frequency which decays with increasing distance from the U-bend.

Table 2 shows the increase in the heat transfer rate for the U-bend design as compared without the U-bend design, it being noted that the heat transfer coefficient is proportional to the square root of the slug frequency for laminer slug flow.

TABLE 1

| Liquid Superficial Velocity, ft/sec (m/sec) | Gas Superficial Velocity, ft/sec (m/sec) | Slug Frequency ($sec^{-1}$) WITH U-BEND MODIFICATION MEASURED AT L/D = 40 | MEASURED AT L/D = 200 | MEASURED WITHOUT U-BEND MODIFICATION |
|---|---|---|---|---|
| 1 (0.30) | 2 (0.61) | 0.506 | 0.291 | |
| 1 (0.30) | 8 (2.44) | 0.321 | 0.229 | |
| 1 (0.30) | 14 (4.27) | 0.455 | 0.217 | |
| 1 (0.30) | 20 (6.10) | 0.417 | 0.299 | |
| 3 (0.91) | 2 (0.61) | 1.507 | 0.980 | 0.813 |
| 3 (0.91) | 8 (2.44) | 0.816 | 0.485 | |
| 3 (0.91) | 14 (4.27) | 0.723 | 0.518 | |
| 3 (0.91) | 20 (6.10) | 0.693 | 0.401 | |
| 5 (1.52) | 2 (0.61) | 2.344 | 1.535 | |
| 5 (1.52) | 8 (2.44) | 1.266 | 0.913 | |
| 5 (1.52) | 14 (4.27) | 1.032 | 0.785 | 0.633 |
| 5 (1.52) | 20 (6.10) | 0.974 | 0.850 | 0.794 |

TABLE 2

| Liquid Superficial Velocity, ft/sec (m/sec) | Gas Superficial Velocity, ft/sec (m/sec) | Increase in Heat Transfer Rate (at L/D of 40) by a factor of |
|---|---|---|
| 3 (0.91) | 2 (0.61) | 1.36 |
| 5 (1.52) | 14 (4.27) | 1.28 |
| 5 (1.52) | 20 (6.10) | 1.11 |

Various changes may be made on the construction and arrangment of parts without departing from the scope of the invention as defined by the following claims. For example, the U-bend design can be used in an upside-down mode, as shown in FIG. 4, to avoid a low point where heavy particles could be trapped. Also, the U-bend design can be installed at irregular intervals to further enhance the heat transfer rate in certain sections of the pipe. For example, one may choose to put more U-bends in the area where gelformation is expected in order to improve heat transfer and dispersion.

What is claimed is:

1. A fired heater having a chamber for heating a multi-phase mixture comprising hydrogen gas and a coal/solvent slurry in a coal liquefaction process which comprises:

(a) an imperforate elongated heat transfer tube for the flow of said multi-phased mixture through said heater;

(b) said transfer tube being constructed and arranged to pass through said chamber of said fired heater in a substantially horizontal path moving vertically up through said heat transfer chamber, wherein said heat transfer tube has U-bends along the length of said tube;

(c) said U-bends being constructed and arranged to provide a flow path through said U-bend portion of said tube wherein said mixture flows downward for a length of said U-bend in said tube and then upward for a length of said U-bend in said tube to resume flow through said elongated substantially horizontal flow path moving vertically up through said chamber;

(d) said U-bends being situated in said tube at intervals less than 200 times the ratio of the length to the diameter of said tube to increase the slug frequency, dispersion of said mixture and to thereby increase the heat transfer efficiency of said transfer tube.

2. A fired heater having a chamber for heating a multi-phase mixture comprising hydrogen gas and a coal/solvent slurry in a coal liquefaction process which comprises:

(a) an imperforate elongated heat transfer tube for the flow of said multi-phase mixture through said heater;

(b) said transfer tube being constructed and arranged to pass through said chamber of said fired heater in a substantially horizontal path moving vertically up through said heat transfer chamber, wherein said heat transfer tube has U-bends along the length of said tube;

(c) said U-bends being constructed and arranged to provide a flow path through said U-bend portion of said tube wherein said mixture flows upward for a length of said U-bend in said tube and then downward for a length of said U-bend in said tube to resume flow through said elongated substantially horizontal flow path moving vertically up through said chamber;

(d) said U-bends being situated in said tube at intervals less than 200 times the ratio of the length to the diameter of said tube to increase the slug frequency, dispersion of said mixture and to thereby increase the heat transfer efficiency of said transfer tube.

3. A fired heater according to claim 2 wherein said U-bends are spaced at regular intervals.

4. A fired heater according to claim 2 wherein said heat transfer tube is inclined slightly to the horizontal at an angle of inclination of about one degree.

5. A fired heater according to claim 2 wherein one or more of said U-bends is located at an irregular interval to enhance the heat transfer rate in certain sections of the transfer tube.

6. A fired heater according to claim 1 wherein said U-bends are spaced at regular intervals.

7. A fired heater according to claim 1 wherein said heat transfer tube is inclined slightly to the horizontal at an angle of inclination of about one degree.

8. A fired heater according to claim 1 wherein one or more of said U-bends is located at an irregular interval to enhance the heat transfer rate in certain sections of the pipe.